United States Patent [19]

Gleason et al.

[11] 4,358,857

[45] Nov. 9, 1982

[54] COMMUNICATION SYSTEM

[75] Inventors: Joseph P. Gleason, Encino; Harry G. Posthumus, Los Angeles, both of Calif.

[73] Assignee: The Magnavox Company, Fort Wayne, Ind.

[21] Appl. No.: 735,089

[22] Filed: May 9, 1958

[51] Int. Cl.[3] ..... H04K 1/00

[52] U.S. Cl. ..... 455/26; 455/30; 179/1.5 R

[58] Field of Search ..... 178/22; 250/6.6, 95; 179/1.5, 1.5 R, 1.5 S; 455/26, 30

[56] References Cited

U.S. PATENT DOCUMENTS

| | | | |
|---|---|---|---|
| 2,175,847 | 10/1939 | Mathers . | |
| 2,237,533 | 4/1941 | Spencer | 178/22 |
| 2,401,855 | 6/1946 | Briggs et al. | 178/22 |
| 2,402,082 | 6/1946 | Rieber | 178/22 |
| 2,479,338 | 8/1949 | Gabrilovitch | 279/1.5 R |
| 2,656,406 | 10/1953 | Gray et al. | 179/1.5 R |
| 2,777,897 | 1/1957 | Gretener et al. | 179/1.5 R |
| 2,953,643 | 9/1960 | Koenig . | |
| 2,999,900 | 9/1961 | DeVries et al. | 179/1.5 R |
| 3,384,705 | 5/1968 | Rosen | 179/1.5 R |
| 3,897,591 | 7/1975 | Lundstrom et al. | 179/1.5 R |

*Primary Examiner*—Howard A. Birmiel

*Attorney, Agent, or Firm*—Charles H. Schwartz; Thomas A. Briody; William J. Streeter

EXEMPLARY CLAIM

1. In combination, a first source for producing a first signal representative of intelligence to be transmitted from one point to another, second source for producing a binary carrier signal having a first voltage level and a second voltage level, means responsive to the first signal and to the binary carrier signal for frequency-modulating the carrier signal in accordance with the first signal to produce a modulated intelligence signal having first and second voltage levels and exhibiting transitions between the same, a third source for producing a binary encoding signl having first and second voltage levels and exhibiting transitions between such levels in conformance with an apparently random predetermined sequence of variations in the encoding signal between the first and second voltage levels at different multiples of a particular time interval, and circuit means coupled to said modulating means and to said third source for inverting the voltage level of the encoding signal from the first voltage level to the second voltage level and from the second voltage level to the first voltage level and upon the simultaneous occurrence of the second voltage level in the intelligence signal to produce an encoded intelligence signal.

5 Claims, 4 Drawing Figures

COMMUNICATION SYSTEM

The present invention relates to communication systems in which intelligence is transmitted in coded form from a transmitting station to one or more receiving stations.

It is often desired to transmit intelligence to a friendly station in such a manner that unfriendly stations cannot assimilate the intelligence. In order to do this, the signals representing the intelligence (hereinafter called the "intelligence signals") must be encoded in a particular manner to produce encoded intelligence signals. The encoded intelligence signals are then transmitted to a receiving station so that the signals can be decoded to obtain the intelligence signals. The intelligence signals are then converted into the proper intelligence in a form which can be easily assimilated.

Certain essentials are required to obtain a proper system of the above character. One requirement is that the intelligence signals be easily encoded at the transmitting station and that the encoded intelligence signals be easily decoded at the friendly receiving stations. Furthermore, the encoding at the transmitting station and the decoding at the receiving station should be accomplished without any loss of intelligence. A concurrent requirement, however, is that the encoding of the intelligence signals be of such a nature that the code cannot be easily broken by unfriendly stations which may receive the encoded intelligence signals. Various attempts have been made to provide a system meeting the above requirements but such attempts have not been entirely satisfactory.

This invention provides a system which meets the above requirements. The criteria outlined in the preceding paragraphs are met in the coded communications system constituting this invention by coding the intelligence signal with an encoding signal having "pseudo-random" characteristics. The term "pseudo-random" is intended to mean signals satisfying most of the requirements of randomness so as to preclude the reception of the intelligence by unauthorized sources. However, the characteristic changes in the encoding signal in reality proceed in accordance with a fixed pattern or program. This enables the encoding signal to be easily duplicated in an authorized or friendly receiver and to be used for decoding purposes.

In the particular embodiment of the invention, a generator is provided to produce signals having first and second amplitude levels. When no intelligence is being transmitted, the generator produces signals which alternate between the first and second amplitude levels at a substantially constant frequency. However, upon the production of intelligence such as audio signals, the signals produced by the generator become modulated in frequency in accordance with the characteristics of the intelligence. Such signals will hereinafter be called the "modulated intelligence signals."

The "modulated intelligence signals" are combined with the encoding signals to produce the pattern of the encoded intelligence signals which are used for transmission. Such combination occurs in a stage designated as a balanced encoder. In such a combination, the pseudo-random encoding signal produced by the signal generator is inverted every time the polarity of the modulated intelligence signals changes.

For example, the pseudo-random encoding signals may be considered to have high and low amplitudes at successive periods which do not have any apparent periodicity. During the time that the modulated intelligence signals have a high amplitude, the encoding signals continue in their original form. However, upon the occurrence of modulated intelligence signals having a low amplitude, the encoding signals become inverted in polarity. This causes encoding signals having a high amplitude to become inverted into encoding signals having a low amplitude and also causes encoding signals having a low amplitude to be inverted into encoding signals having a high amplitude.

Each receiver at a friendly station has a decoder which produces signals in a pseudo random pattern corresponding to the signals produced by the encoder at the transmitting station. The pseudo-random decoding signals are mixed with the signals sent from the transmitting station to the receiving station to recover the modulated intelligence signals. The recovered signals are then introduced to a discriminator which operates to convert the frequency modulation into signals having corresponding amplitude modulations.

Because of the particular characteristics of the system constituting this invention, an encoded intelligence signal may be transmitted to a particular receiver with such low power density in the frequency domain, that the signals appear to unfriendly receiver to be below the usual noise level. The reason is that the unfriendly receiver is not aware of the pseudo-random encoding pattern so that the resultant signals have a pseudo-random pattern which appear at the unfriendly receiver to correspond to the pseudo-random pattern of noise. However, upon decoding at the friendly receiver of the encoded intelligence signal, the recovered signal has a sufficiently narrow frequency band so that its amplitude becomes boosted above the background noise level. This is especially true when the recovered signal is filtered by a narrow-band filter. In this way, it is possible for the very existence of the coded intelligence signal to be hidden from unauthorized receivers. Also it is difficult for the encoded intelligence signal to be effectively jammed by hostile sources.

IN THE DRAWINGS

Figure 1:
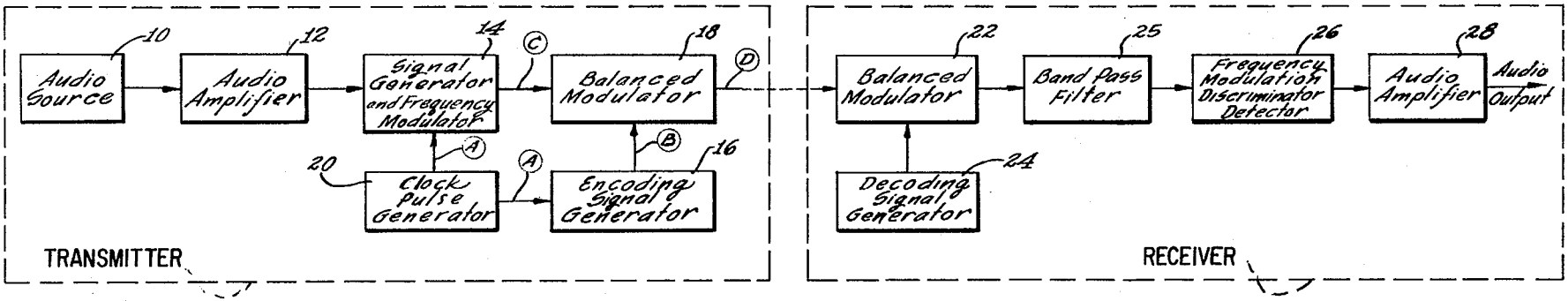
FIG. 1 is a schematic representation of the secrecy communication system of the invention, this representation showing in block form the various components which constitute one embodiment of the transmitter portion of the system and those making up one embodiment of the receiver portion of the system.

As shown in FIG. 1, the system of the invention includes a source of intelligence such as an audio source 10. This source may be a microphone, or it may be any other source of voice signals or of other types of intelligence signals to be transmitted by the system. The source 10 may be connected to an amplifier such as an audio amplifier 12 which serves a well-known function of amplifying the audio or intelligence signals. The amplifier 12 is, in turn, connected to a signal generator and frequency modulator 14, so that the amplifier intelligence signal from the amplifier may be introduced to that generator to modulate a carrier signal generated by it.

The signal generator portion of the unit 14, may for example, be a frequency modulated sine-wave oscillator (as will be described in FIG. 4) connected to drive a bistable flip-flop circuit. The sine-wave generator portion of the unit 14 may, for example, have a center frequency of 25 kilocycles, so that the bistable flip-flop circuit will generate a signal having a rectangular wave shape and having a center frequency of 25 kilocycles. Alternately, the signal generator portion of the unit 14 may be a multivibrator having a natural frequency of, for example, 25 kilocycles. The frequency of the multivibrator may be directly controlled by the intelligence signal from the amplifier 12 so that a frequency-modulated signal may be directly developed and at any instant be dependent upon the characteristics of the intelligence signal from the amplifier 12.

The signal from the audio amplifier, as noted above, is introduced to the frequency modulator portion of the unit 14 to frequency modulate the rectangular-wave carrier signal from the signal generator portion of the unit 14. The audio amplifier may, for example, change the frequency of the carrier signal from the signal generator portion of the unit 14 by a frequency up to ±5 kilocycles during the frequency modulation process. As previously described, the frequency of the carrier signal at any instant is dependent upon the characteristics of the intelligence signal at that instant such as the amplitude of the audio signal from the source 10.

Of course, the suggested 25 kilocycle natural frequency of the signal generator and the deviation of that frequency by an amount up to ±5 kilocycles are not critical parameters, and other frequencies and frequency deviations may be used. The signal generator portion of the unit 14, therefore, generates a rectangular-wave carrier signal. This signal exhibits amplitude transitions between two fixed amplitude values, and the timing of these transition changes in accord with the intelligence signal from the audio amplifier.

When a sine-wave oscillator and flip-flop circuit are used to constitute the signal generator portion of the unit 14, as suggested above, the signal from the audio amplifier 12 can be used to frequency modulate the output signal of the signal generator by any usual frequency modulator network associated with the sine-wave oscillator. For example, a Hartley oscillator may be used as a signal generator in conjunction with any known type of reactance-tube network as a modulator to constitute the signal generator and frequency modulator 14. Alternately, when the signal generator is a multivibrator, as suggested above, the frequency of the output signal may be varied in accordance with the intelligence of the signal from the amplifier 12 by causing the intelligence signal to control the return grid voltage of the multivibrator .

The system shown in FIG. 1 also includes an encoding signal generator 16. This generator produces an encoding signal having a rectangular wave shape. This encoding signal has amplitude transitions between two fixed amplitude values which are controlled to occur in accordance with a predetermined coding sequence. This coding sequence, as indicated above, may be of a pseudo random nature and actually be in accordance with a definite pattern and be repetitive to facilitate the production of similar decoding signals at the various receiver portions of the system, thus simplifying the equipment required to generate such decoding signals. The encoding signal generator takes any appropriate form. For example, it may be of a type which will be described in some detail subsequently. This encoding signal generator is similar to those described in a report by Neal Zierler, entitled "Several Binary-Sequence Generators," Massachusetts Institute of Technology, Lincoln Laboratories, Technical Report No. 95. The signal generator 16 may also be constructed in a manner similar to that disclosed in co-pending application Ser. No. 714,459 filed February 6, 1958, by Joseph P. Gleason.

Figure 2:
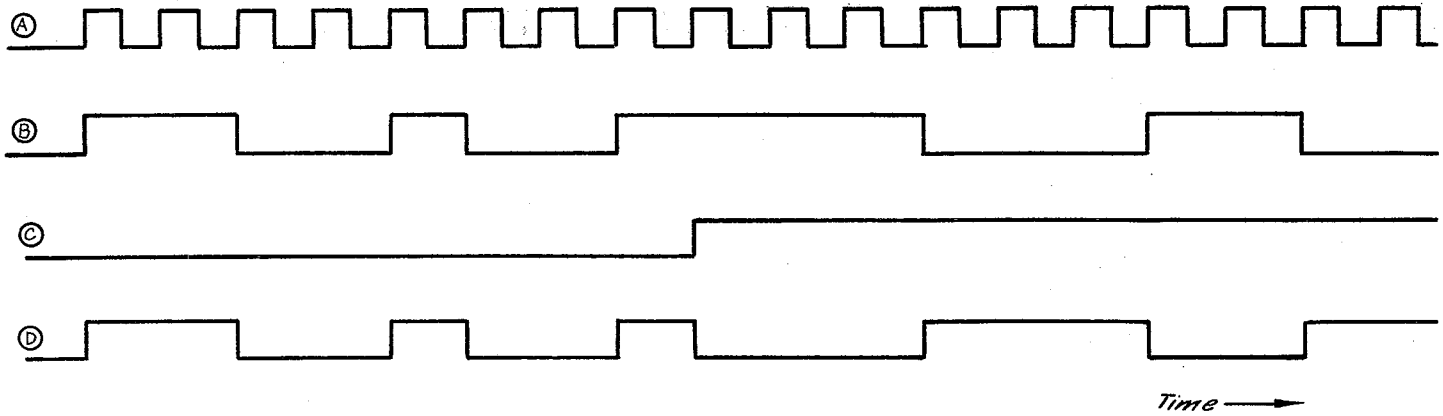
FIG. 2 is a series of curves showing the various wave forms developed at the transmitter portion of the illustrated embodiment of the secrecy communication system of the invention, these curves being useful in explaining the operation of the invention and in explaining the functioning of the various components making up the system.

The signals from the encoding signal generator 16 are introduced to a balanced encoder 18, and the frequency modulated carrier from the signal generator and frequency modulator 14 is also introduced to the balanced encoder 18. The balanced encoder 18 functions in a manner to be described to invert the encoding signal from the generator 16 in response to the frequency modulated signals from the unit 14. Thus, the encoded intelligence signal produced at the output terminal of the balanced modulator 18 is a signal having a rectangular-wave shape as illustrated in curve D of FIG. 2 and having certain amplitude transitions from one of its fixed amplitudes to the other. These amplitude transitions result in part from inversions of the encoding signal from the generator 16, the encoding signals being shown in curve B of FIG. 2. By "inversion" is meant that the encoding signals of high amplitude become changed to encoding signals of low amplitude and the encoding signals of low amplitude become changed to encoding signals of high amplitude when the intelligence signals have a particular amplitude such as a high amplitude. The amplitude transitions in the encoded intelligence signals also result in part from the amplitude transitions in the modulated intelligence signal from the frequency modulator portion of the unit 14, one transition of which is shown in FIG. 2, curve C. The encoded intelligence signal from the encoder 18 may be transmitted to the receiver portion of the system by any known means. For example, the output signal from the encoder 18 may be introduced to a suitable radio transmitter for radiation to the friendly receiver.

The system also preferably includes a clock pulse generator 20. This generator produces clock timing signals which are defined by a series of regularly timed clock pulses recurring at a stabilized and constant repetition frequency. The signals from the generator 20 are introduced to the encoding signal generator 16 so that each amplitude transition in the rectangular-wave encoding signal will occur in timed coincidence with a corresponding one of the clock pulses. Also, the clock pulses are introduced to the signal generator portion of the unit 14 so that each amplitude transition in the modulated intelligence signal from the unit 14 will also occur in timed coincidence with one of the clock pulses. The frequency of the clock pulse generator may be made relatively high with respect to the frequency in the amplitude transitions of the modulated intelligence signal from the unit 14, so that the control exerted by the clock pulses on that signal will not shift the transitions sufficiently to cause noticeable distortion in the modulated intelligence signal produced by the unit 14 or in the encoded intelligence signals produced by the encoder 18. For example, the clock pulses from the generator 20 may have a repetition frequency of the order of 1 megacycle.

By using the clock pulses from the generator 20 to control the operation of the signal generator portion of the unit 14 and to control the operation of the encoding signals generator 16, the amplitude transitions in the encoded intelligence signal coming from the encoder 18 are synchronized with the amplitude transitions in the clock signal. This precludes any possibility that an unauthorized person will distinguish between the amplitude transitions in the modulated intelligence signal and the amplitude transitions in the encoded intelligence signal so as to decode and analyze the encoded intelligence signals transmitted toward the friendly receivers.

The sequence of clock timing pulses from the generator 20 is shown in the curve A of FIG. 2. These pulses may be considered as a sequence of positive pulses occurring at regular intervals and having a repetition frequency of, for example, 1 megacycle. These signals do not represent the carrier signals, which are actually not shown in FIG. 2. The encoding signal from the generator 16 is shown in the curve B of FIG. 2 and may be provided with a rectangular wave shape as shown. The amplitude transitions of the encoding signal shown in curve B of FIG. 2 are in accordance with a pseudo random coding sequence. The sequence is described as "pseudo random" since it appears to be random but is actually repetitive. The amplitude transitions of the encoding signal shown in curve B of FIG. 2 are also controlled by the clock pulses from the generator 20 so that each amplitude transition occurs in timed coincidence with the leading edge of a clock pulse. Encoding signal generators are known which are capable of generating a binary encoding signal having amplitude transitions which are produced in a pseudo random progression and which are timed by clock pulses. Such encoding signal generators are described in the report referred to previously. One type of such an encoding signal generator will be described in some detail subsequently in conjunction with FIG. 4.

The modulated intelligence signal produced by the unit 14 is shown in the curve C of FIG. 2. This modulated signal also has a binary rectangular wave shape in the illustrated embodiment. The times of occurrence of the amplitude transitions in the modulated intelligence signal shown in curve C of FIG. 2 are controlled by the intelligence signal from the audio amplifier 12 in the manner described. In the illustrated embodiment, and as also described, these transitions in the modulated intelligence signal are also controlled by the clock pulses so that, in each instance, they occur in timed coincidence with the leading edge of the clock pulse. The timing in the amplitude transitions of the modulated intelligence signal of curve C is affected by only a slight amount by the added control of the clock pulses, when the repetition frequency of the clock pulses is high as compared with the frequency of the signal from the generator portion of the unit 14. As mentioned previously, this minimizes any errors in intelligence in the encoded intelligence signals as a result of synchronization by the clock pulses.

The intelligence signal from the amplifier 12 is, therefore, caused to frequency modulate a carrier signal from the signal generator portion of the unit 14. The resultant modulated intelligence signal at the output of the unit 14 may be suitably shaped by any known network to have a negligible amplitude modulation. For example, the output signals from the operator 14 may be shaped by a limiter or any other type of clamping circuit which passes signals only up to a particular amplitude.

As shown in the curve D of FIG. 2, the encoding signal from the generator 16 is passed without inversion by the unit 18 when the amplitude of the modulated intelligence signal from the unit 14 is in one of its binary states. Alternately, the unit 14 operates to invert the amplitude of the encoding signal from the generator 16 when the amplitude of the signal from the unit 14 is in its second binary state. It will be seen from the above discussion and from FIGS. 1 and 2 that the modulator 18 produces the signals shown in Curve D of FIG. 2. These signals are then used to modulate carrier signals having a particular frequency, and the modulated carrier signals are transmitted to the friendly receiver.

That is, each amplitude transition of the modulated intelligence signal from the unit causes the balanced encoder 18 to invert the amplitude of the encoding signal from the generator 16. The resultant encoded intelligence signal produced at the output terminal of the balanced encoder 18 is shown in the curve D. It will be observed that the first portion of the encoded intelligence signal shown in the curve D of FIG. 2 is similar to the encoding signal shown in the curved B of FIG. 2. However, each time the modulated intelligence signal shown in the curve C of FIG. 2 undergoes an amplitude transition, the encoding signal shown in curve B of FIG. 2 is immediately inverted to produce the encoded intelligence shown in the curve D of FIG. 2. This may be seen by comparing the curves B and D of FIG. 2 when the modulated intelligence signal shown in the curve C changes from a low amplitude to a high amplitude. When this occurs, the ensuing amplitude transitions in the encoded intelligence signal of the curve D continue to occur in accodance with amplitude transitions in the encoding signal of the curve B but in the opposite sense. That is, a signal of high amplitude in the encoding signal shown in the curve B is inverted into a coded intelligence signal of low amplitude in the curve D and vice versa when the modulated intelligence signal shown in curve C has a high amplitude.

The use of the clock pulses of the curve A to control the operation of both the encoding signal generator 16 and the signal generator portion of the unit 14 assures that all the amplitude transitions involved in the production of the encoded intelligence signal shown in the curve D of FIG. 2 will occur with the same basic timing. Therefore, it is impossible for the encoded intelligence signal to be analyzed at an unauthorized station for distinction between the amplitude transitions in the modulated intelligence signal and in the encoding signal.

A reshaping circuit may be included after the balanced encoder 18 to reshape the encoded intelligence signal and to assure that there will be no amplitude modulation or spurious frequency modulation of that signal at the times when the amplitude of the encoded intelligence signal changes between a high value and a low value. It is, of course, most essential that the appearance of the phase-inverted portions of the encoded intelligence signal be identical to the appearance of its non-inverted portions with respect to rise times, amplitudes and transitions times, and the reshaping circuit assures that this will be the case. As previously described, the phase-inverted portions of the encoded intelligence signals occur when the modulated intelligence signal shown in the curve C of FIG. 2 has a high amplitude.

A suitable receiver portion of the system includes a balanced decoder 22 which may be similar to the balanced modulator 18 at the transmitter. The balanced decoder 22 may be preceded, of course, by suitable preamplifier or other input stages for receiving and amplifying the signal from the transmitter. A broken line is shown between the modulator 18 and the modulator 22 to indicate the transmission of signals from the transmitter including the modulator 18 to the receiver including the modulator 22.

The receiver also includes a decoding signal generator 24. As noted previously, this decoding signal generator generates a decoding signal which has a rectangular-wave shape and in which amplitude transitions occur in the same coding sequence as those of the encoding signal from the encoding signal generator 16 at the transmitter. The decoding sequence will be, as noted, of a pseudo-random repetitive nature, similar to those shown in the curve B of FIG. 2 this source being synchronized with clock pulses from a generator corresponding to the generator 20 at the transmitter.

The balanced decoder 22 at the receiver may be connected to a band-pass filter 25, which in turn is connected to a frequency-modulation discriminator 26. The discriminator in turn is connected to an amplifier 28 from which the intelligence may be recovered. The amplifier 28 may be an audio amplifier when the intelligence is represented by aural communications.

The decoding signal introduced by the generator 24 to the balanced decoder 22 causes the balanced decoder to invert the encoded intelligence signal from the transmitter at the precise points at which it was inverted at the transmitter by the encoding signal generator 16. This occurs by a comparison in the decoder 22 of the encoded intelligence signals and the signals from the decoding generator 24 so that signals of low amplitude are produced during an identity in the amplitudes of the compared signals and so that a signal of high amplitude is produced upon a difference in the amplitudes of the compared signals. Therefore, the balanced decoder 22 develops an output signal similar to the signal shown in the curve C of FIG. 2.

The output signal from the decoder 22 has a rectangularwave shape and exhibits amplitude transitions at the same frequency as the amplitude transitions of the frequency modulated signal from the signal generator and frequency modulator 14. The frequency modulated signal from the decoder 22 is passed by the band-pass filter 25 to the frequency discriminator 26. The discriminator 26 processes the frequency-modulated signal and produces an intelligence signal which closely duplicates the signal which had originated at the audio source 10 in the transmitter. This intelligence signal is amplified in the amplifier 28, and the intelligence represented by it is recovered by any suitable transducer (not shown) such as a loud speaker, when the intelligence is aural.

The filter 25 may be a narrow-band, band-pass filter of known inductance-capacity type. It serves to pass the modulated intelligence signal and the modulation side bands of this signal from the balanced decoder 22 to the discriminator 26. However, the filter 25 discriminates against the background noise signals having a relatively wide frequency band outside of the frequency range of the modulated intelligence signal.

By using the balanced decoder 22 and the band-pass filter 25, certain advantages are obtained. This may be seen from the fact that the production of the modulated intelligence signal and the combination of this signal with the encoding signal to obtain the encoded intelligence signal produce progressive increases in the bandwidth of the transmitted signal. This results from the fact that the modulated intelligence signal has a suitable control frequency such as 25 kilocycles and from the fact that the encoding signal may have a bandwidth such as 1 megacycle. Since the energy level represented by the intelligence is now distributed over a bandwidth of at least 1 megacycle, the energy level of the intelligence in the encoded intelligence signal is considerably decreased in comparison to the energy level of the intelligence itself. Actually, the energy level of the intelligence in the encoded intelligence signal may be below the apparent noise level in the atmosphere.

The decoder 24 reduces the bandwidth from at least one megacycle to a bandwidth of 10 kilocycles at a center frequency of 25 kilocycles. This provides a first action in increasing the energy level since, in correlation and de-correlation processes, the energy level is inversely related to the bandwidth. The filter 25 then acts to filter out signals having frequencies below 20 kilocycles and above 30 kilocycles. The signal passed by the filter 25 now has sufficient amplitude over its spectrum with respect to the residual noise signals translated by that filter, so that the signal may be detected in the discriminator 26 and its intelligence recovered at the output of the amplifier 28.

Figure 3:
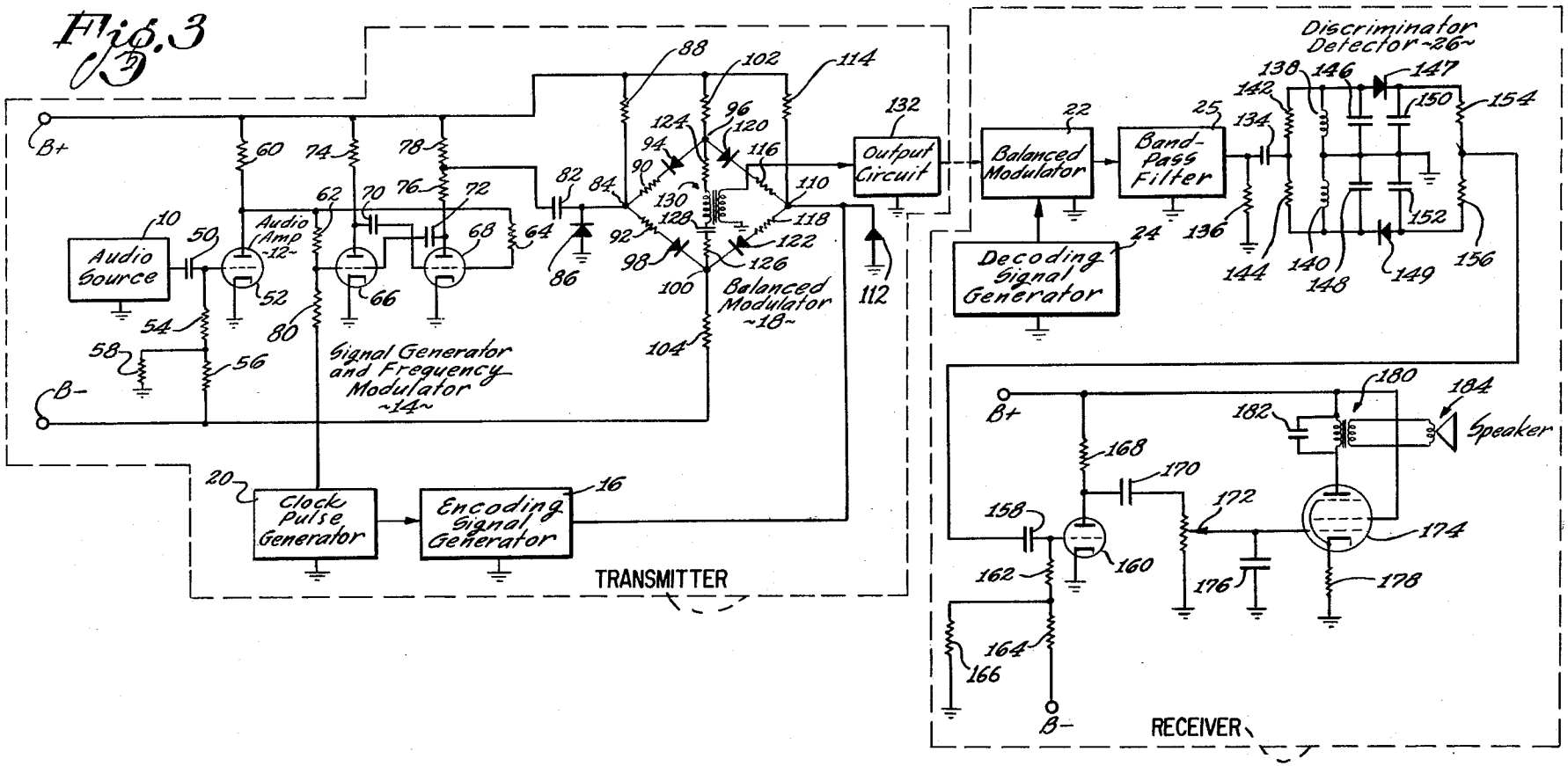
FIG. 3 is a detailed diagram showing partly in block form the various components constituting a particular embodiment of the secrecy communication system of the invention.

Different components included in the system of FIG. 1 are shown in more detail in FIG. 3. Certain ones of these components are shown in circuit form in FIG. 3. However, since others in themselves are extremely well-known to the art, they are shown merely in block form. For example, the audio source 10, the clock pulse generator 20 and the encoding signal generator 16 are shown in block form in FIG. 3. These components may have any suitable known configuration, and it is believed unnecessary to describe the detailed circuitry of any of them. Likewise, the encoding signal generator 16 may be of any known type, as mentioned previously. This generator, as described above, responds to the pulses from the clock pulse generator 20 to produce a series of pulses occurring at different times and having different durations. However, these latter pulses are controlled and timed by the pulses from the clock pulse generator, and the coding pattern which determines their occurrence and duration may have a repetitive nature so that it can be conveniently duplicated by the decoding signal generator 24 at the receiver.

The audio source 10 is connected to a capacitor 50 which may have a capacity of 0.1 microfarads. The capacitor 50 is connected to the control grid of a triode 52, the cathode of which is grounded. The triode 52 and its associated circuitry make up the audio amplifier 12. A pair of series connected resistors 54 and 56 are connected between the control grid of the triode 52 and the negative terminal of the direct-voltage source "B". The voltage value of this source may be of the order of 150 volts. A resistor 58 is connected to the junction of the resistors 54 and 56 and to ground. The resistors 56 and 58 form a voltage divider between the negative terminal of the direct voltage source "B" and ground so that a negative bias voltage of a desired value may be introduced to the control grid of the triode 52. The resistor 54 may have a value of 330 kilo-ohms, the resistor 56 may have a value of 470 kilo-ohms, and the resistor 58 may have a value of 2700 ohms.

A resistor 60 having a value of, for example, 15 kilo-ohms, is connected to the anode of the triode 52 and to the positive terminal of a direct-voltage source indicated "B". The voltage value of this source may be of the order of 150 volts. The anode of the triode 52 is also connected to a resistor 62 and to a resistor 64. Each of these latter resistors may have a resistance of 270 kilo-ohms. The resistor 62 is connected to the control grid of a triode 66, and the resistor 64 is connected to the control grid of a triode 68. The cathodes of these two triodes are grounded. A capacitor 70 is connected to the anode of the triode 66 and to the control grid of the triode 68, and a capacitor 72 is connected to the control grid of the triode 66 and to the anode of the triode 68. Each of these capacitors may have a capacity of 100 micro-microfarads. A resistor 74 is connected to the anode of the triode 66, and a resistor 76 is connected to the anode of the triode 68. The resistor 74 may have a resistance of 24 kilo-ohms and the resistor 76 may have a resistance value of 22 kilo-ohms. A resistor 78 of, for example, 2 kilo-ohms is connected to the resistor 76, and the resistors 74 and 78 are connected to the positive terminal of the voltage source "B".

A 270 kilo-ohm resistor 80 is connected to the control grid of the triode 66 and to an output terminal of the clock pulse generator 20. This resistor serves to introduce the clock pulses to the control grid of the triode 66.

The triodes 66 and 68 are connected as a known type of multivibrator circuit. This circuit has a natural frequency, for example, of 25 kilocycles. The audio signals from the audio source 10, however, cause the audio amplifier 12 to develop an audio signal across the resistor 60. This audio signal controls the grid return voltage of the triodes 66 and 68 which in turn varies the frequency of the multivibrator on either side of its natural frequency. The frequency deviation of the multivibrator may be of the order of 5 kilocycles.

The resistor 80 causes the clock pulses to be introduced to the control grids of the multivibrator tubes as superimposed on the audio signals. As noted above, it is preferable that the clock pulses be first differentiated and clipped to have a sharp spike-like configuration, before these pulses are applied to the multivibrator. The relationship is such that in each instance, the multivibrator is triggered by a clock pulse slightly before it would be normally triggered. This causes the actual amplitude transitions of the output signal from the multivibrator to occur at times that are controlled by the clock pulses, for the reasons described in the preceding paragraphs. As noted above, the frequency of the clock pulses may be of the order of 1 megacycle so that the slight differences in triggering of the multivibrator 14 due to the clock pulses instead of at the natural frequency, creates no noticeable distortions in the coded transmitted signal.

Figure 4:
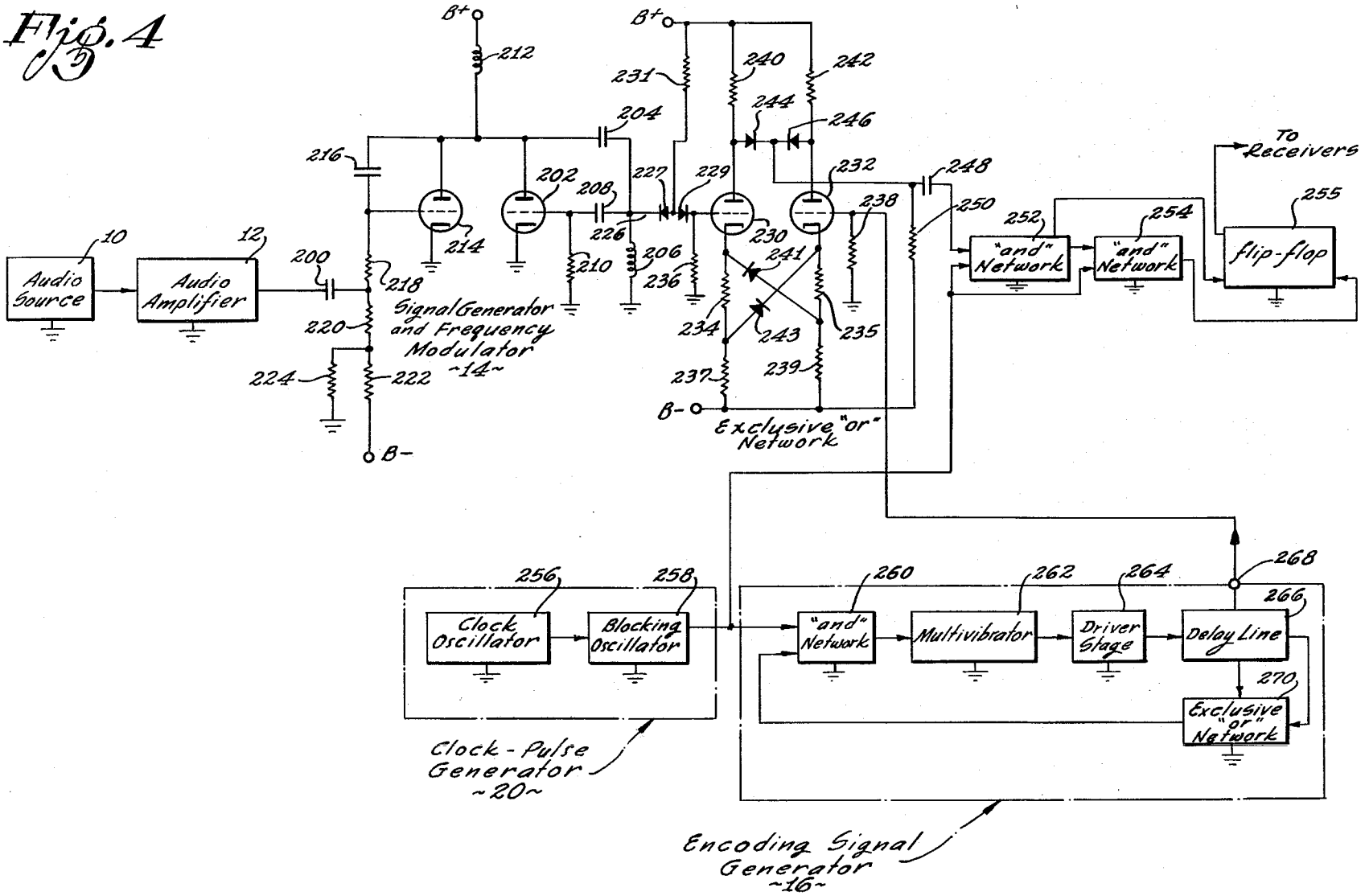
FIG. 4 is a portion of the system of the invention in modified form.

The junction of the resistors 76 and 78 is connected to a coupling capacitor 82 which in turn is connected to a terminal 84 of the balanced modulator 18. A diode 86 has its anode grounded and has its cathode connected to the terminal 84. As noted above, the function of the balanced encoder 18 is to cause the encoding signal from the signal generator 16 to be periodically inverted by the modulated intelligence signal from the signal generator portion of the unit 14, so as to produce the encoded intelligence signal to be transmitted. When so desired, the balanced encoder 18 may be replaced by an "exclusive or" network. Such an arrangement is shown in the embodiment of FIG. 4 and shall be described in conjunction with that embodiment.

A resistor 88 having a resistance, for example, of 10 kilo-ohms is connected to the terminal 84 and to the positive terminal of the direct voltage source "B." A pair of resistors 90 and 92 are connected to the terminal 84, and each of these resistors may have a resistance of 270 ohms. A diode 94 has its cathode connected to the resistor 90, and the anode of this diode is connected to a terminal 96 of the balanced encoder. Likewise, a diode 98 has its anode connected to the resistor 92, and the cathode of the latter diode is connected to a terminal 100 of the balanced encoder. A resistor 102 having a resistance of, for example, 30 kilo-ohms is connected to the terminal 96 and to the positive terminal of the direct-voltage source "B." Likewise, a resistor 104 having a resistance of 30 kilo-ohms is connected to the terminal 100 and to the negative terminal of the direct-voltage source "B".

The output terminal of the encoding signal generator 16 is connected to an input terminal 110 of the balanced encoder 18. A diode 112 has its anode grounded, and the cathode of that diode is connected to the terminal 110 of the balanced encoder 18. A resistor 114 is connected to the input terminal 110, and this resistor is also connected to the positive terminal of the direct voltage source "B". The resistor 114 may have a resistance of 10 kilo-ohms. A pair of resistors 116 and 118 are also connected to the input terminal 110. Each of these resistors may have a resistance of 270 ohms. The resistor 116 is connected to the cathode of a diode 120, the anode of that diode being connected to the terminal 96. In like manner, the resistor 118 is connected to the anode of a diode 122, the cathode of that diode being connected to the terminal 100.

A pair of 15-ohm resistors 124 and 126 are connected respectively to the terminals 96 and 100. A capacitor 128 is connected to the resistor 126, and this capacitor has a capacity of 0.1 microfarads. The primary winding of a transformer 130 is connected to the resistor 124 and to the capacitor 128. The primary and secondary windings of this transformer may each have 500 turns, and each may exhibit an inductance of 0.008 henries. One side of the secondary winding of the transformer 130 is grounded, and the other side is connected to the input terminal of a unit 132 which includes the usual output circuits for the transmitter.

The diode 86 serves to limit the negative excursion of the modulated intelligence signal introduced from the signal generator and frequency modulator 14 to the input terminal 84 of the balanced encoder 18 to ground or zero. Likewise, the diode 112 limits the negative excursion of the encoding signal from the signal generator 16 to ground or zero.

The illustrated balanced encoder 18 operates effectively to invert the encoding signal when the modulated intelligence signal undergoes a transition from one of its fixed amplitude values to the other. For example, when the modulated intelligence signal introduced to the input terminal 84 of the balanced encoder 18 is at its zero amplitude value, the terminal 96 of the modulator is held at ground potential. Then, when the encoding signal from the generator 16 has its zero amplitude value the output is zero, but when the encoding signal has its positive amplitude value a current flows through a circuit including the diode 122 and the primary of the transformer 130 to the terminal 96, which is at zero potential. This current causes voltage to be induced in the secondary winding of the transformer. For the zero amplitude condition of the modulated intelligence signal, therefore, a binary output signal is introduced to the output circuit 132. This binary output signal has zero amplitude when the encoding signal from the generator 16 is zero and it has maximum amplitude when the encoding signal is positive.

Now, when the modulated intelligence signal introduced to the input terminal 84 of the balanced encoder is at its positive value, the current flow upwardly through the primary winding 130 occurs when the encoding signal is in its zero amplitude state to establish the terminal 96 at ground potential. The path of that current flow is through the diode 98 and upwardly through the primary winding of the transformer 130. Then, when the encoding signal returns to its positive amplitude value, no current is able to flow through the primary winding of the transformer and no voltage is induced in the secondary winding. For the positive condition of the modulated intelligence signal from the signal generator and frequency modulator 14, therefore, the output signal is in its positive state during the time that the encoding signal from the generator 16 is in its zero amplitude state; the output signal is in its zero state when the encoding signal is positive.

Therefore, the balanced encoder 18 responds to the binary modulated intelligence signal from the unit 14 to invert the encoding signal from the generator 16. The resultant amplitude transitions in the encoded intelligence signal occur, as shown by the curves of FIG. 2, in accordance with the coding sequence of the encoding signal and in accordance with the amplitude transitions of the modulated intelligence signal. The output circuit 132, therefore, produces a coded intelligence signal, as shown in the curve D of FIG. 2, and this signal is transmitted to the receiver portion of the system.

The receiver portion of the system in FIG. 2 includes the balanced decoder 22, the decoding signal generator 24 and the band-pass filter 25 (referred to previously). The balanced decoder 22 may be similar to the balanced encoder 18 at the transmitter, which is described above, and for that reason the decoder 22 is shown merely in block form. The band-pass filter 25 may be any usual inductance-capacity band-pass filter, and it need not be shown in circuit form. For example, this filter may be tuned to pass a 25 kilocycle signal, and may exhibit a pass-band of 10 kilocycles.

The band-pass filter 25 is connected to a coupling capacitor 134 and to a grounded resistor 136. The capacitor 134 may have a capacity of 0.1 microfarads, and the resistor 136 may have a resistance of 47 kilo-ohms. The capacitor 134 is connected to the discriminator 26. This discriminator may have a usual form, and it may include a pair of inductance coils 138 and 140. The coil 138 may have an inductance of 0.02 henries, and the coil 140 may have an inductance of 0.009 henries. The coils 138 and 140 are shunted by a pair of series-connected resistors 142 and 144. Each of these resistors may have a resistance of 20 kilo-ohms, and the capacitor 134 is connected to the common junction of the resistors.

The common junction of the inductance coils 138 and 140 is grounded, and these coils are respectively shunted by a pair of tuning capacitors 146 and 148. Each of these capacitors may have a capacity of 0.0031 microfarads, and they form tuned circuits with the respective coils 138 and 148. These tuned circuits are resonant at different frequencies slightly above and below the center frequency of the received frequency modulated signal. The ungrounded sides of the coils 138, 140 and of the capacitors 146 and 148 are connected respectively to the anode of a diode 147 and to the cathode of a diode 149. A pair of grounded capacitors 150 and 152 are connected respectively to the cathode of the diode 147 and to the anode of the diode 149. These latter capacitors may have a capacity of 1500 micro-microfarads. The capacitors 150 and 152 are connected to a pair of load resistors 154 and 156. These resistors 154 and 156 may each have a resistance of 20 kilo-ohms.

The circuit of the discriminator 26 described above is of known form, and a detailed description of its operation is believed to be unnecessary. As is well-known, the modulation components of the frequency modulated signal charge the capacitors 150 and 152 and may be recovered at the common junction of the resistors 154 and 156. In this way, the potential at the common terminal of the resistors 154 and 156 is related to the frequency of the signal introduced to the discriminator at any instant.

The common junction of the resistors 154 and 156 is connected to a coupling capacitor 158 of, for example, 0.1 microfarads. This coupling capacitor is connected to the control grid of a triode 160 which serves as a voltage amplifier. The cathode of the triode 160 is grounded, and its control grid is connected to one terminal of a pair of series-connected resistors 162 and 164. The common junction of these resistors is connected to a grounded resistor 166. The other terminal of the series-connected resistors is connected to the negative terminal of the voltage source "B." The resistor 162 may have a resistance of 470 kilo-ohms, the resistor 164 may have a resistance of 2200 kilo-ohms. The function of these resistors is to provide the proper bias potential to the control grid of the triode 160.

A resistor 168 of, for example, 47 kilo-ohms is connected to the anode of the triode 160 and to the positive terminal of the voltage source "B". The anode of this triode is also connected to a coupling capacitor 170 having a capacity of, for example, 0.1 microfarads. The coupling capacitor 170 is connected to one terminal of a potentiometer 172, the other terminal of this potentiometer being grounded. The potentiometer 172 may have a resistance between its fixed terminals of 0.25 megohms. The armature of the potentiometer 172 is connected to the control grid of a pentode 174. This pentode is connected as a power amplifier. A capacitor 176 is shunted between the armature of the potentiometer 172 and ground. This capacitor may have a capacity of 0.001 microfarads. A degenerative resistor 178 is connected to the cathode of the pentode 174 and to ground. This resistor may have a resistance of 180 ohms. The suppressor grid of the pentode 174 is connected to the cathode, and its screen grid is connected to the positive terminal of the direct voltage source "B." The anode of the pentode 174 is connected to the primary of an output transformer 180. The primary of the transformer 180 is shunted by a 0.01 microfarad capacitor 182. The secondary winding of the transformer 180 is connected to a speaker 184.

Therefore, and in the manner described, the audio signals from the audio source 10 are used to frequency modulate a binary type rectangular-wave shape signal from the signal generator portion of the unit 14. This signal then is used to encode a binary type rectangular-wave encoding signal from the encoding signal generator 16. This latter function is accomplished in the balanced encoder 18 at the transmitter. In the particular described embodiment, the modulated intelligence signal from the unit 14 has pseudo-random characteristics and it serves to invert the phase of the encoding signal from the signal generator 16 for every amplitude transition of the encoding signal. The resulting coded output signal is a binary type rectangular wave signal in which certain amplitude transitions are due to the audio intelligence and others are due to the transitions of the original encoding signal.

The receiver develops a decoding signal having the same coding sequence as the encoding signal at the transmitter, as described, so that the amplitude transitions of the encoding intelligence signal resulting from the encoding signal can be compensated and cancelled. The decoding signal generator 24 at the receiver is also driven by a clock generator which produces a clock signal identical to the clock signal produced by the clock pulse generator 20 at the transmitter. The band-pass filter 25 then translates a signal having amplitude transitions corresponding only to those due to the modulated intelligence signal from the signal generator and frequency modulator 14. The latter signal is detected in the discriminator 26, and it is amplified in the circuits of the discharge tubes 160 and 174. The original audio intelligence may, therefore, be reproduced by the speaker 184.

In the modified system of FIG. 4, the signal generator and frequency modulator 14 is illustrated as a Hartley sine-wave oscillator controlled by a reactance tube circuit, and the balanced encoder 18 of FIG. 1 is replaced by an "exclusive or" network. Also, the clock pulse generator 20 is shown in more detail in FIG. 4, as is the encoding signal generator 16. In the modified embodiment of FIG. 4, the clock pulse generator 20 is shown as controlling the output signal from the signal generator portion of the unit 14 and controlling the encoding signal from the signal generator 16, so as to synchronize the amplitude transitions in the encoded intelligence signal with the clock pulses from the clock pulse generator 20 for the reasons described above.

The audio amplifier 12 in the embodiment of FIG. 4 is connected to a capacitor 200, and this capacitor serves to couple the amplifier to the input of the signal generator and frequency modulator 14. This coupling capacitor may have a capacity of 0.1 microfarads. The signal generator and frequency modulator 14 in the present embodiment includes a triode 202 which is connected as a sine-wave Hartley oscillator. The cathode of the triode 202 is grounded, and its anode is connected to a capacitor 204. The capacitor 204 may have a capacitance of 2200 micro-microfarads. The capacitor 204 is connected to an inductance coil 206 and to a capacitor 208. The inductance coil 206 is grounded, and the capacitor 208 is connected to the control grid of the triode 202. A grounded resistor 210 is also connected to the control grid. The inductance coil 206 may have an inductance of 0.005 henries, the capacitor 208 may have a capacitance of 0.01 microfarads, and the resistor 210 may have a resistance of 470 kilo-ohms. An inductance coil 212 of 0.01 henries is connected to the anode of the triode 202 and to the positive terminal of the direct voltage source "B."

The signal generator 14 in FIG. 4 also includes a triode 214. The triodes 202 and 214 may be included in a single envelope such as a dual triode of the type presently designated 12AT7. The triode 214 is connected as a reactance tube frequency modulator, and its cathode is grounded and its anode is connected to the anode of the triode 202. A capacitor 216 is connected to the anode of the triode 214 and to its control grid. This capacitor may have a capacitance of 100 micro-microfarads. A resistor 218 is connected to the control grid of the triode 214 and to the coupling capacitor 200. A pair of series-connected resistors 220 and 222 are connected to the common junction of the capacitor 200 and the resistor 218 and to the negative terminal of the direct voltage source "B." A grounded resistor 224 is connected to the common junction of the resistors 220 and 222. The resistor 218 may have a resistance of 5600 ohms, the resistor 220 may have a resistance of 470 kilo-ohms, the resistor 222 may have a resistance of 330 kilo-ohms, and the resistor 224 may have a resistance of 2700 ohms.

The circuit of the triode 202 oscillates at a natural frequency which is determined by its circuit parameters. This frequency, for example, may be of the order of 25 kilocycles. The audio signal from the audio amplifier 12 controls the current flow through the reactance tube 214 to shift the frequency of the oscillator by an amount up to $\pm 5$ kilocycles, for example, depending upon the amplitude of the audio signal at any instant. A frequency modulated sine wave output is developed, therefore, at the output terminal 226 of the signal generator.

The output terminal 226 is connected to the cathode of a diode 227, and the anode of the diode 227 is connected to the anode of a diode 229. The cathode of the diode 229, in turn, is connected to the control grid of a triode 280. A resistor 231 is connected between the common anodes of the diodes 227 and 229 and the positive terminal B+ of the source of direct voltage. The triode 230 and a further triode 232 are connected to constitute an "exclusive or" network. These triodes, likewise, may be included in a single envelope to constitute a tube of the type presently designated 12AT7.

The cathodes of the triodes 230 and 232 are connected respectively to a resistor 234 and a resistor 235, and these resistors are returned to the negative terminal of the direct voltage source "B" are respective resistors 237 and 239. Each of the resistors 234 and 235 may have a value of 680 ohms, and each of the resistors 237 and 239 may have a value of 50 kilo-ohms. A grounded resistor 236 is connected to the control grid of the triode 230, and a grounded resistor 238 is connected to the control grid of the triode 232. The resistor 236 may have a value of 10 kilo-ohms and the resistor 238 may have a value of 100 ohms. The control grid of the triode 232 is connected to the output terminal of the encoding signal generator 16. The cathode of the triode 230 is connected to the cathode of a diode 241, and the anode of this diode is connected to the junction of the resistors 235 and 239. Likewise, the cathode of the triode 232 is connected to the cathode of a diode 243, and the anode of the latter diode is connected to the junction of the resistors 237 and 234.

The anode of the triode 230 is connected to a resistor 240, and the anode of the triode 232 is connected to a resistor 242. Each of these resistors may have a resistance of 3300 ohms, and both are connected to the positive terminal of the voltage source "B". A diode 244 has its anode connected to the anode of the triode 230, and a diode 246 has its anode connected to the anode of the triode 232. The cathodes of the diodes 244 and 246 are connected together and to a coupling capacitor 248. This coupling capacitor may have a capacity of 0.1 microfarads. A resistor 250 connects the cathodes of the diodes 244 and 246 to the output terminal of the negative power supply, and this resistor may have a resistance of 330 kilo-ohms.

When the frequency modulated output signal from the unit 14 is introduced to the cathode of the diode 227, the diode passes only a lower part of the positive swing of the sine wave due to the positive bias voltage established at its anode by the voltage divider formed by the resistors 231 and 236. Also, the diode 229 prevents the negative portions of the output signal from reaching the control grid of the triode 230. Therefore, the network made up of these diodes and their associated resistors effectively transforms the frequency modulated sine wave output signal from the unit 14 into a frequency modulated binary signal having a first state in which it exhibits a positive amplitude value, and have a second state in which it exhibits zero value. This binary signal is applied to the control grid of the triode 232.

At the same time, the encoding signal applied to the control grid of the triode 232 has two amplitude values as before, a positive amplitude and a zero amplitude. The diodes 241 and 243 provide an implitude delay for the "exclusive or" network. The diode 241 prevents any slight changes in the conduction of the triode 232 due to noise signals and the like, from affecting the conduction of the triode 230. Likewise, the diode 243 prevents any slight changes in the conduction of the triode 230 from affecting the conduction of the triode 232. Only when the conduction of the triode 232 is increased sufficiently so that the voltage at the junction of the resistors 235 and 239 exceeds the voltage at the cathode of the triode 230 will the diode 241 conduct and cause the voltage on the cathode of the triode 230 to be altered. Likewise, only when the conduction of the triode 230 is increased sufficiently to cause the voltage at the junction of the resistors 234 and 237 to exceed the voltage at the cathode of the triode 232 will the diode 243 conduct and cause the voltage on the latter cathode to be controlled.

When the encoding signal introduced to the control grid of the triode 232 is in its zero amplitude state, the conduction through that triode is at a selected value provided that the potential at the cathode of the triode is at a low value. During this condition, when the signal introduced to the control grid of the triode 230 is zero, a selected conduction is also experienced through the triode 230 provided that the potential at the cathode of that triode is at a low value. Because of the cross couplings through the diodes 241 and 243 to the cathodes of the tubes 230 and 232, the cathodes of both tubes receive low potentials when low potentials are introduced to the grids of both tubes. Since the tubes 230 and 232 are both conductive, the resultant potential drops across the resistances 240 and 242 cause the output potential produced across the resistor 250 to be at its minimum amplitude value.

Now, when the signal applied to the control grid of the triode 230 changes to its positive amplitude state, the conduction through the triode 230 is increased, and this increases the cathode bias on the triode 232 to further decrease the conduction through the triode 232, if it is assumed that the grid of triode 232 remained at zero. The resulting rise in plate voltage of the latter triode causes the output signal across the resistor 250 to rise to its maximum value.

On the other hand, when the encoding signal introduced to the control grid of the triode 232 is in its positive amplitude state, the conduction through the triode 232 is at a maximum and its plate voltage is at a minimum if the signal applied to the control grid of the triode 230 is zero. The bias on the cathode of the triode 230 causes its plate voltage to have a maximum value. This causes the output signal across the resistance 250 to have its maximum value since the signal is able to pass through the diode 244 to the resistance. Now, when the signal applied to the control grid of the triode 230 shifts in amplitude to its positive state, the resulting increased conduction through the triode 230 reduces the output signal to its minimum value, if the grid of the triode 232 remains at a high level.

The overall result, therefore, of the "exclusive or" network is to accomplish the same purpose as the balanced modulator circuit in the previous embodiment. That is, the modulated intelligence signal from the unit 14 functions to invert the encoding signal from the generator 16 each time that the modulated intelligence signal undergoes an amplitude transition from one of its binary states to the other.

The output signal from the "exclusive or" network described above is introduced through the capacitor 248 to an "and" network 252. "And" networks are well-known to the digital computer electronic art. These networks usually include a plurality of interconnected diodes or transistors, and they are constructed to pass a signal to a common output terminal when a plurality of signals are simultaneously applied to all their input terminals.

The "and" network 252 is connected to a similar "and" network 254 to cause the latter to be conditioned for conduction when the former is nonconductive, and vice versa. The output terminal of the "and" network 252 is connected to the left input terminal of a flip-flop 255, and the output terminal of the "and" network 254 is connected to the right input terminal of the flip-flop. The flip-flop 254 is a circuit well-known to the electronic art. It is essentially a bistable network that may be triggered from a first to a second stable operational state in response to a pulse introduced to its left input terminal, and it may be returned to its first stable operational state in response to a pulse introduced to its right input terminal. In one operational state, the flip-flop exhibits a relatively low voltage at its left output terminal, and in the other operational state, it exhibits a relatively high voltage at that output terminal. The left output terminal of the flip-flop is shown as connected to the link extending to the distant receivers.

When the voltage across the resistor 250 is at its relatively low amplitude value, the "and" network 252 is rendered nonconductive and the "and" network 254 is conditioned to translate the clock pulses introduced to its input terminal. The first clock pulse to occur after a transition in the voltage across the resistor 250 to its relatively low value triggers the flip-flop 255 to its second stable operational state.

The flip-flop 255 remains in its second stable operational state until the voltage across the resistor 250 exhibits a transition to its relatively high amplitude value. Now the "and" network 252 is conditioned to translate the clock pulses and the "and" network 254 is rendered nonconductive. Upon the introduction of the first clock pulse after the "and" network 252 becomes prepared to translate the clock pulses, the flip-flop 255 becomes returned to its first operational state. Therefore, the flip-flop 255 produces an output wave for transmission to the receivers and this output wave is similar to the wave of the curve D of FIG. 2. That is, the "and" networks 252 and 254 and the flip-flop 255 cause the amplitude transitions of the encoded intelligence signal from the "exclusive or" network to be synchronized with the clock pulses. The flip-flop 255 also serves as a wave-shaper for the output wave.

The clock pulse generator 205 is shown in FIG. 4 as comprising a clock oscillator 256. This oscillator may, as noted above, be any stable sine wave generator. The signals from the clock oscillator 256 are introduced to a blocking oscillator 258, and these signals drive the blocking oscillator. The output pulses from the blocking oscillator are precisely timed by the pulses from the clock oscillator 256, and the function of the blocking oscillator is to "sharpen" the clock signals to produce triggering pulses. The output terminal of the blocking oscillator is connected to the "and" network 252 and to the "and" network 254.

As described in conjunction with the previous embodiment, it is desired that all of the amplitude transitions in the encoded intelligence signal occur in coincidence with the clock pulses from the blocking oscillator 258. In the preceding embodiment, this was achieved by using the clock pulses from the generator 20 to control the operation of the signal generator portion of the unit 14 and the encoding signal generator 16. In the embodiment of FIG. 4, the result is achieved in the manner described by the "and" networks 252 and 254 and by the flip-flop 255.

The flip-flop 255 provides the encoded intelligence signal with a desired rectangular configuration, and it also provides that each amplitude transition is measured by a clock pulse. As noted above, when the frequency of the clock pulses is made considerably higher than the frequency of the modulated intelligence signal, no noticeable distortions occur in the output signal.

The encoding signal generator 16 is shown in FIG. 4 as including an "and" network 260 to which the blocking oscillator 258 is connected. The "and" network 260 is connected to a multivibrator 262 of any usual construction, and the multivibrator in turn is connected to a driver stage 264. The driver stage 264 is in turn connected to a delay line 266. An intermediate point on the delay line 266 is connected to the output terminal 268 of the encoding signal generator 16, this output terminal being connected to the control grid of the triode 232 of the "exclusive or" network described above. The end point of the delay line 266 is connected to an "exclusive or" network 270, as is a further intermediate point on the delay line. The output terminal of the "exclusive or" network 270 is connected back to the "and" network 260.

The operation of the encoding signal generator may be explained by considering the delay line 266 as, for example, a 4-bit delay line or storage register, (each bit interval being measured by the clock pulse generator 20). Originally the delay line may be in a state in which no pulse is passing through it, and then each bit in the line may be considered as: −0000. Now, if a pulse is introduced to the line from the driver stage 264, this pulse will start down the line and for the next three bit intervals the following conditions will arise in the line: −1000, 0100 and 0010.

Assuming that one input terminal of the "exclusive or" network 270 is connected to a point on the delay line 266 corresponding to the third bit, then as the pulse travels from the third bit position in the line to the fourth bit position, it will also pass through the "exclusive or" network 270 and be recirculated to the first bit position. This, therefore, creates the situation: −1001 for the next bit interval. Now, the pulse at the end of the line is moved through the "or" network and recirculated for the next bit interval to create the situation: −1100. The two pulses now travel down the line to the: −1011 condition. The "exclusive or" network 270 will not pass both pulses at the 3-bit and at the 4-bit position, and no pulse is passed by it for the next condition which, is therefore: −0101.

The operation continues with pulses passing down the delay line 266 from one bit position to another and then being recirculated under the control of the "exclusive or" network 270. The "and" network 260 assures that the pulse circulation in the encoding signal generator will remain properly timed by the clock pulses. Each circulating pulse may condition the "and" network 260 for conduction, and the next clock pulse passes through the "and" network and triggers the multivibrator 262. The multivibrator supplies a clean, sharp pulse to the driver stage 264 in response to each recirculated pulse.

It is possible, therefore, to control the encoding signal generator 16 by the clock pulses, and cause a preselected pattern of pulses to pass down the delay line 266.

The encoding signal developed by the generator 16 appears to have random characteristics. However, it has a predictable wave shape, and an identical wave can be produced at the receivers by feeding properly controlled clock pulses into a similarly constructed decoding unit.

It may be shown, that the coding sequence of the particularly described encoding signal generator will repeat after $(2^n-1)$ bit intervals, where n=the number of bits in the delay line, provided that certain suitable tap positions are used. Because of the great number of bit intervals in each coding sequence, the pulses appear to have a random characteristic. Obviously, the repetition rate of the code can be decreased merely by increasing the delay of the delay line. Also, flexibility in the code can be obtained by varying the points on the delay line at which the input terminals of the "exclusive or" network 270 are connected.

The invention provides, therefore, an improved system in which a transmitted signal may be completely and adequately coded. However, the coding of the signal is such that the decoding may be achieved in authorized receiving stations by means of relatively simple apparatus and in accordance with relatively simple coding and decoding schedules. Moreover, the inclusion of balanced encoders at the transmitting station and the use of balanced decoders and band-pass filters at the receiving stations permits actual existence of the transmitted signal to be masked and hidden in background noise signals.

Although this application has been disclosed and illustrated with reference to particular applications, the principles involved are susceptible of numerous other applications which will be apparent to persons skilled in the art. The invention is, therefore, to be limited only as indicated by the scope of the appended claims.

We claim:

1. In combination, a first source for producing a first signal representative of intelligence to be transmitted from one point to another, a second source for producing a binary carrier signal having a first voltage level and a second voltage level, means responsive to the first signal and to the binary carrier signal for frequency-modulating the carrier signal in accordance with the first signal to produce a modulated intelligence signal having first and second voltage levels and exhibiting transitions between the same, a third source for producing a binary encoding signal having first and second voltage levels and exhibiting transitions between such levels in conformance with an apparently random predetermined sequence of variations in the encoding signal between the first and second voltage levels at different multiples of a particular time interval, and circuit means coupled to said modulating means and to said third source for inverting the voltage level of the encoding signal from the first voltage level to the second voltage level and from the second voltage level to the first voltage level and upon the simultaneous occurrence of the second voltage level in the intelligence signal, to produce an encoded intelligence signal.

2. In combination, a first source for producing a first signal representative of intelligence to be transmitted from one point to another, a second source for producing a rectangular-wave carrier signal having a first voltage level and a second voltage state, means responsive to the first signal and the carrier signal for frequency-modulating the carrier signal in accordance with the first signal to produce a modulated intelligence signal having a rectangular-wave shape, a third source for producing an encoding signal having a rectangular-wave shape and having first and second voltage levels and exhibiting transitions between such levels in conformance with an apparently random predetermined sequence of variations in the encoding signal between the first and second voltage levels at different multiples of a particular time level, and circuit means coupled to said modulating means and to said third source for modifying the voltage of the encoding signal in conformance with the transitions in the voltage of the modified intelligence signal to produce an encoded intelligence signal exhibiting first voltage transitions corresponding to voltage transitions in the encoding signal during the first voltage level in the modulated intelligence signal and exhibiting further voltage transitions opposite to the voltage transitions in the encoding signal during the second voltage level in the modulated intelligence signal.

3. In a coded communication system, the combination of, a first source for producing a first signal representative of intelligence to be transmitted, a second source for producing a rectangular-wave binary carrier signal, means responsive to the first and second signals for frequency-modulating the carrier signal with the first signal to produce a rectangular-wave binary frequency-modulated signal having a first voltage level and a second voltage level and exhibiting voltage transitions between such levels at frequencies at any instant dependent upon the intelligence to be transmitted, a third source for producing a series of regularly recurring clock timing pulses, means responsive to the clock pulses and to the modulated intelligence signal for causing each of the voltage transitions of the modulated intelligence signal to occur in timed coincidence with the clock pulses, a fourth source for producing a binary rectangular-wave encoding signal having first and second voltage levels and occurring at different multiples of a particular time interval, means responsive to the clock pulses and to the encoding signal for obtaining each transition in the encoding signal in timed coincidence with a corresponding one of the clock pulses, and circuit means responsive to the encoding signal and to the modulated intelligence signal for modifying the encoding signal in conformance with the transitions in the modulated intelligence signal to produce a rectangular wave binary encoded intelligence signal exhibiting first voltage transitions corresponding to voltage transitions in the encoding signal during the first voltage level in the modulated intelligence signal and exhibiting further voltage transitions opposite to the voltage transitions in the encoding signal during the second voltage level in the modulated intelligence signal.

4. In a coded communication system in which a rectangular wave frequency-modulated binary coded signal is transmitted to a remote point, such coded signal having first and second voltage levels and exhibiting transitions between such levels in correspondence with a modulated intelligence signal having frequency modulations representing the transmitted intelligence and in accordance with apparently random predetermined transitions in a rectangular wave binary encoding signal wherein the encoded intelligence signal has voltage levels corresponding to the voltage levels in the encoding signals during the occurrence of the first voltage levels in the intelligence signals and wherein the encoded intelligence signal has voltage levels opposite to the voltage levels in the encoding signal during the occurrence of the second voltage level in the intelligence signal and where the random transitions occur at different multiples of a particular periodicity between the successive voltage variations in the encoding signal, the combination of, a source for producing a rectangular wave binary decoding signal synchronized with the encoding signal and having first and second voltage levels and apparently random transitions therebetween conforming to the same code sequence as the encoding signal, a balanced decoder coupled to the source and responsive to the decoding signal and to the encoded intelligence signal for causing the voltage levels of the encoded intelligence signal to be inverted by the decoding signal during the second voltage level in the intelligence signal to obtain the modulated intelligence signal, and discriminator means coupled to the balanced decoder and responsive to the frequency modulations in the modulated intelligence signal for recovering the intelligence from the modulated intelligence signal.

5. The combination defined in claim 4 in which a band pass filter is interposed between the balanced decoder and the detector means to pass the modified signal to the detector means.

* * * * *